United States Patent [19]

Gorski

[11] Patent Number: 4,767,561

[45] Date of Patent: Aug. 30, 1988

[54] AZEOTROPE OR AZEOTROPE-LIKE COMPOSITION OF TRICHLOROTRIFLUOROETHANE, METHANOL AND 1,2-DICHLOROETHYLENE

[75] Inventor: Robert A. Gorski, Newark, Del.

[73] Assignee: E. I. Du Pont de Nemours and Company, Wilmington, Del.

[21] Appl. No.: 100,220

[22] Filed: Sep. 23, 1987

[51] Int. Cl.[4] ..... C11D 7/50

[52] U.S. Cl. ..... 252/171; 134/31; 134/42; 252/364

[58] Field of Search ..... 252/171, 364; 134/31, 134/42

[56] References Cited

U.S. PATENT DOCUMENTS

| | | | |
|---|---|---|---|
| 2,999,816 | 9/1961 | Bennett et al. | 252/171 |
| 3,349,039 | 10/1967 | Renault | 252/171 |
| 3,455,835 | 7/1969 | Burt | 252/172 |
| 3,960,746 | 6/1976 | Gorski | 252/171 |
| 4,268,407 | 5/1981 | Hey et al. | 252/171 |

*Primary Examiner*—Robert Wax

*Attorney, Agent, or Firm*—James E. Shipley

[57] ABSTRACT

Azeotropic admixture of 1,1,2-trichloro-1,2,2- trifluoroethane, methanol, and 1,2-dichloroethylene useful in solvent cleaning applications.

7 Claims, No Drawings

AZEOTROPE OR AZEOTROPE-LIKE COMPOSITION OF TRICHLOROTRIFLUOROETHANE, METHANOL AND 1,2-DICHLOROETHYLENE

BACKGROUND OF THE INVENTION

As modern electronic circuit boards evolve toward increased circuit and component densities, thorough cleaning of the boards after soldering becomes more important. Current industrial processes for soldering electronic components to circuit boards involve coating the entire circuit side of the board with a flux and thereafter passing this coated side of the board over preheaters and through molten solder. The flux cleans the conductive metal parts and promotes adhesion of the solder. Commonly used fluxes consist, for the most part, of rosin used alone or with activating additives such as amine hydrochlorides or oxalic acid derivatives.

After soldering, which thermally degrades part of the rosin, the flux and flux residue are often removed from the board with an organic solvent.

Current industrial processes for cleaning the circuit boards after soldering involve the use of vapor defluxing techniques. In the conventional operation of a vapor defluxer, the board is passed through a sump of boiling organic solvent which removes the bulk of the rosin (including thermally degraded rosin) and thereafter through a sump containing freshly distilled solvent near room temperature, and finally through solvent vapor over a boiling sump which provides a final rinse with clean solvent which condenses on the circuit board. In addition, the board can also be sprayed with distilled solvent before the final rinse.

It can be seen, therefore, that the requirements of a solvent to be used in cleaning circuit boards are very stringent. Such a solvent should have a relatively low boiling point, be nonflammable, have low toxicity, and exhibit high solvency for flux and flux residue.

Ideally, such a solvent would be a single pure solvent, but in practice it has not been possible to provide such a single solvent with the above-mentioned desired characteristics. Therefore in the art, it has been the practice to use a mixture of solvents to control boiling, flammability and solvent power characteristics.

While solvent mixtures may be carefully designed to effectively control boiling, flammability and solvent power characteristics, such a solvent mixture is not necessarily useful in the industrially used circuit board cleaning procedure such as the vapor defluxing technique as described above. The major deterrent to the use of such solvent mixtures is that of fractionation to an undesirable degree during use. For example, in the vapor defluxing technique described above, the first stage of cleaning consists of passing the circuit board into a sump of boiling organic solvent under which conditions the lower boiling component of the solvent mixture may be vaporized leaving behind a solvent mixture with altered characteristics. Again in this cleaning procedure, the final rinsing is carried out by passing the cleaned circuit board through solvent vapors over a boiling sump which provides the final rinse with clean pure solvent which condenses on the circuit board wherein any fractionation may alter the solvency characteristics. And finally, for the cleaning procedures to be economically viable, the used solvent must be readily recovered for reuse which in the case of liquid solvent is usually by distillation and then there must be an assurance that the recovered solvent has the same composition and characteristics as the original solvent system.

On the other hand, azeotropic mixtures, with their constant boiling and constant composition characteristics, have been found to be very useful. Azeotropic mixtures exhibit either a maximum or minimum boiling point and do not fractionate upon boiling. These characteristics are also important in the use of the solvent compositions to remove solder flux and flux residue from printed circuit boards. Preferential evaporation of the more volatile components of the solvent mixtures, which would be the case if they were not azeotropes, or azeotrope-like, would result in mixtures with changed compositions which may have less desirable properties, such as lower solvency for rosin flux, less inertness toward the electrical components and increased flammability. These are also desirable in vapor degreasing operations where redistilled material is usually used for final rinse-cleaning. Thus, the vapor defluxing or degreasing system acts as a still. Unless the solvent composition exhibits a constant boiling point, i.e. is an azeotrope or is azeotrope-like, fractionation will occur and undesirable solvent distribution may act to upset the safety and effectiveness of the cleaning operation.

Unfortunately, as recognized in the art, it is not possible to predict the formation of azeotropes and this obviously complicates the search for new azeotropic systems which have application in this field. Nevertheless, there is a constant effort in the art to discover new azeotropes or azeotrope-like systems which have desirable solvency characteristics and particularly a greater versatility of solvency power.

One organic solvent found to be useful in the circuit board cleaning art is 1,1,2-trichloro-1,2,2-trifluoroethane ($CCl_2FCClF_2$), which may be designated as CFC-113, because of its nonflammability, low toxicity and inertness to the components of the circuit boards. To increase the flux-dissolving ability of CFC-113, it has been suggested that more active solvents for flux, such as lower alcohols, be added.

A number of fluorocarbon based azeotropic compositions have been discovered and in some cases used as solvents for the removal of solder flux and flux residue from printed circuit boards and for miscellaneous vapor degreasing applications. For example, U.S. Pat. Nos. 3,960,746 and 3,455,835 disclose azeotropic-like mixtures of 1,1,2-trichloro-1,2,2-trifluoroethane and trans-1,2-dichloroethylene and U.S. Pat. No. 2,999,816 discloses a binary azeotrope of 1,1,2-trichloro-1,2,2-trifluoroethane and methanol.

It is an object of the present invention to provide a nonflammable azeotrope or azeotrope-like solvent composition useful for solvent cleaning applications.

SUMMARY OF THE INVENTION

According to the present invention, an azeotrope or azeotrope-like composition has been discovered comprising an admixture of effective amounts of 1,1,2-trichloro-1,2,2-trifluoroethane ($CCl_2FCClF_2$), methanol, and 1,2-dichloroethylene ($CHCl{=}CHCl$).

DETAILED DESCRIPTION OF THE INVENTION

The compositions of the present invention comprise admixtures of effective amounts of 1,1,2-trichloro-1,2,2-trifluoroethane, methanol, and 1,2-dichloroethylene which compositions form azeotropes or azeotrope-like compositions. 1,2-dichloroethylene can exist in two different isomeric forms, the trans-1,2-dichloroethylene and the cis-1,2-dichloroethylene.

By effective amounts is meant the amounts of each component of the admixture of the instant invention, which, when combined, results in the formation of the azeotrope of azeotrope-like admixtures of the instant invention.

As recognized in the art, an azeotrope or an azeotrope-like composition is an admixture of two or more different components which, when in liquid form under given pressure, will boil at a substantially constant temperature, which temperature may be higher or lower than the boiling temperatures of the components, and which will provide a vapor composition essentially identical to the liquid composition undergoing boiling. The essential features of an azeotrope or an azeotrope-like composition are that at a given pressure, the boiling point of the liquid composition is fixed and that the composition of the vapor above the boiling composition is essentially that of the boiling liquid composition, i.e., no fractionation of the components of the liquid composition takes place. It is also recognized in the art that both the boiling point and the weight percentages of each component of the azeotropic composition may change when the azeotrope or azeotrope-like liquid composition is subjected to boiling at different pressures. Thus an azeotrope or an azeotrope-like composition may be defined in terms of the unique relationship that exists among components or in terms of the compositional ranges of the components or in terms of exact weight percentages of each component of the composition characterized by a fixed boiling point at a specified pressure.

The present compositions comprise azeotrope or azeotrope-like admixtures of 1,1,2-trichloro-1,2,2-trifluoroethane, methanol and 1,2-dichloroethylene, more specifically, the present composition comprises a mixture of about 64 to 72 weight percent 1,1,2-trichloro-1,2,2-trifluoroethane, about 5 to 7 weight percent methanol and about 23 to 29 weight percent trans-1,2-dichloroethylene. Additionally, the present compositions comprise azeotrope or azeotrope-like mixtures of about 93 weight percent 1,1,2-trichloro-1,2,2-trifluoroethane, about 6 weight percent methanol and about 1 weight percent cis-1,2-dichloroethylene.

Each of the components of the present composition is known in the art.

It is not possible to predict the formation of azeotropes. Therefore, it was surprising and unexpected that each of the isomeric forms of 1,2-dichloroethylene with 1,1,2-trichloro-1,2,2-trifluoroethane and methanol form azeotrope of azeotrope-like mixtures with drastically different compositions. The 1,2-dichloroethylene may contain both trans-1,2-dichloroethylene and cis-1,2-dichloroethylene; for example, trans-1,2-dichloroethylene may contain about 5 weight percent cis-1,2-dichloroethylene.

The ternary mixture of about 64 to 72 weight percent 1,1,2-trichloro-1,2,2-trifluoroethane, about 5–7 weight percent methanol and about 23 to 29 weight percent trans-1,2-dichloroethylene may be characterized as azeotrope-like in that mixtures within this range exhibit a substantially constant boiling temperature and substantially no change in the composition between the composition of the vapor and the composition of the initial solution. Careful, precision distillation has established that the composition containing about 68 weight percent 1,1,2-trichloro-1,2,2-trifluoroethane, about 6 weight percent methanol and about 26 weight percent trans-1,2-dichloroethylene constitutes a true ternary azeotrope which boils at 38.4° C. at atmospheric pressure (760 mm Hg) and is the preferred composition of the present invention.

In addition, careful, precision distillation has established that the composition containing about 93 weight percent 1,1,2-trichloro-1,2,2-trifluoroethane, about 6 weight percent methanol and about 1 weight percent cis-1,2-dichloroethylene boils at about 39.7° C. at atmospheric pressure (760 mm Hg).

Since the atmospheric boiling points of 1,1,2-trichloro-1,2,2-trifluoroethane is 47.6° C., that of methanol is 65° C., that of trans-1,2-dichloroethylene is 48.9° C. and that of cis-1,2-dichloroethylene is 60.1° C., the azeotropes or azeotrope-like compositions of this invention boiling at 38.4° C. and 39.7° C. at atmospheric pressure constitute minimum boiling azeotropic compositions.

The compositions of the present invention can be prepared by any convenient method including mixing or combining the desired amounts of each component. A preferred method is to weigh the desired amounts of each component and thereafter combine them in an appropriate container.

The compositions of the present invention are useful as solvents in many applications and are particularly useful in cleaning electronic circuit boards after the soldering process. As an example, the azeotropic mixture of this invention can be used in cleaning processes such as is described in U.S. Pat. No. 3,881,949, which is incorporated herein by reference.

The present preferred solvent systems have relatively low boiling points, are nonflammable, have relatively low toxicity and exhibit high solvency for flux and flux residue. The compositions of the present invention permit easy recovery and reuse as solvents without loss of their desirable characteristics because of their azeotropic nature and the relatively low boiling point.

EXAMPLE 1

A composition containing 68.2 weight percent 1,1,2-trichloro-1,2,2-trifluoroethane (CFC-113), 5.9 weight percent methanol and 25.9 weight percent trans-1,2-dichloroethylene was prepared by weighing out each of the components and mixing in a suitable container. The trans-1,2-dichloroethylene contained less than five percent of the cis isomer.

The mixture was distilled in a Perkin-Elmer Model 251 Autoannular (spinning band) still with a 200 plate fractionating capability using 10/1 reflux/take-off ratio. The head and pot temperatures were read directly to 0.01° C. and 0.1° C. respectively. All temperatures were adjusted to 760 mm pressure. The compositions were determined by gas chromatography. The results are tabulated in the Table.

TABLE

Distillation of CFC-113/Methanol/Trans-1,2-Dichloroethylene 68.2/5.9/25.9

| | Distillation Cut | | | | | | |
|---|---|---|---|---|---|---|---|
| | Fore-shot | 1 | 2 | 3 | 4 | 5 | Heel |
| Weight % Distilled or Recovered | 5 | 27 | 50 | 68 | 89 | 95 | 98 |
| Head Temp, ° C. | 38.27 | 38.30 | 38.33 | 38.34 | 38.39 | 38.40 | — |

TABLE-continued

| Distillation of CFC-113/Methanol/Trans-1,2-Dichloroethylene 68.2/5.9/25.9 | | | | | | | |
|---|---|---|---|---|---|---|---|
| | Distillation Cut | | | | | | |
| | Fore-shot | 1 | 2 | 3 | 4 | 5 | Heel |
| | Composition (Wt %) | | | | | | |
| CFC-113 | 67.9 | 68.04 | 67.98 | 67.95 | 67.96 | 68.01 | 70.7 |
| Methanol | 6.1 | 5.99 | 6.00 | 6.08 | 6.04 | 6.03 | 4.9 |
| Trans-1,2-Dichloro-ethylene | 26.0 | 25.97 | 26.02 | 25.97 | 26.00 | 25.96 | 24.4 |

Analysis of the above data indicates very small changes in both the boiling points and the compositions as the distillation progressed. Statistical analysis of the data also indicates that the true ternary azeotrope of 1,1,2-trichloro-1,2,2-trifluoroethane, methanol and trans-1,2-dichloroethylene has the following characteristics at atmospheric pressure (99.9% confidence limits).

| | |
|---|---|
| CFC-113 | (wt %) 67.98 ± 0.24 |
| Methanol | (wt %) 6.03 ± 0.18 |
| Trans-1,2-Dichloroethylene | (wt %) 25.98 ± 0.12 |
| Boiling Point (°C., 760 mm Hg) | 38.35 ± 0.29 |

EXAMPLE 2

The following is representative of a cleaning operation to which the present azeotropic compositions are applicable.

A single sided circuit board was coated with activated rosin flux and soldered by passing the board over a preheater to obtain a top side board temperature of about 200° F. and then through a 500° F. molten solder. The soldered board was defluxed in an azeotropic mixture of 68 weight percent CFC-113, 6 weight percent methanol and 26 weight percent trans-1,2-dichloroethylene (of Example 1) by suspending it first for three minutes in the boiling sump, then, one minute in the rinse sump and then for one minute in the solvent vapor above the boiling sump. Careful examination of the thus-cleaned circuit board showed no visible signs of any residue thereon.

I claim:

1. An azeotrope or azeotrope-like composition comprising about 64 to 72 weight percent 1,1,2-trichloro-1,2,2-trifluoroethane, about 5 to 7 weight percent methanol and about 23 to 29 weight percent trans-1,2-dichloroethylene.

2. The azeotrope or azeotrope-like composition of claim 1 wherein the composition is about 68 weight percent 1,1,2-trichloro-1,2,2-trifluoroethane, about 6 weight percent methanol and about 26 weight percent trans-1,2-dichloroethylene with a boiling point of about 38.4° C. at atmospheric pressure.

3. A azeotrope or azeotrope-like composition of comprising about 93 weight percent 1,1,2-trichloro-1,2,2-trifluoroethane, about 6 weight percent methanol and about 1 weight percent cis-1,2-dichloroethylene with a boiling point of about 39.7° C. at atmospheric pressure.

4. A process for cleaning a solid surface which comprises treating said surfaces with the azeotrope or azeotrope-like composition of claim 1.

5. The process of claim 4 wherein said solid surface is a printed circuit board contaminated with flux and flux residue.

6. A process for cleaning a solid surface which comprises treating said surfaces with the azeotrope or azeotrope-like composition of claim 3.

7. The process of claim 6 wherein said solid surface is a printed circuit board contaminated with flux and flux residue.

* * * * *